US005703548A

United States Patent [19]

Särkkä

[11] Patent Number: 5,703,548

[45] Date of Patent: Dec. 30, 1997

[54] DIELECTRIC RESONATOR HAVING ADJUSTMENT PLATES MOVABLE WITH RESPECT TO RESONATOR DISC AND EACH OTHER

[75] Inventor: Veli-Matti Särkkä, Oulunsalo, Finland

[73] Assignee: Nokia Telecommunications Oy, Espoo, Finland

[21] Appl. No.: 640,794

[22] PCT Filed: Oct. 4, 1995

[86] PCT No.: PCT/FI95/00545

§ 371 Date: Jun. 4, 1996

§ 102(e) Date: Jun. 4, 1996

[87] PCT Pub. No.: WO96/11509

PCT Pub. Date: Apr. 18, 1996

[30] Foreign Application Priority Data

Oct. 5, 1994 [FI] Finland ..... 944661

[51] Int. Cl.[6] ..... H01P 7/10

[52] U.S. Cl. ..... 333/235; 333/219.1

[58] Field of Search ..... 333/219.1, 223–226, 333/231–233, 235

[56] References Cited

U.S. PATENT DOCUMENTS 4,477,788 10/1984 Collinet et al. ..... 333/235

4,565,979 1/1986 Fiedziuszko ..... 331/117 D 4,849,722 7/1989 Cruchon et al. ..... 333/205

5,315,274 5/1994 Sarkka ..... 333/219.1

FOREIGN PATENT DOCUMENTS 0294301 12/1987 Japan ..... 333/202 DR

*Primary Examiner*—Robert Pascal

*Assistant Examiner*—Barbara Summons

*Attorney, Agent, or Firm*—Cushman Darby & Cushman Intellectual Property Group of Pillsbury Madison & Sutro LLP

[57] ABSTRACT

A dielectric resonator including a dielectric resonator disc, a frequency controller including an adjustment mechanism and a dielectric adjustment plate, which is substantially parallel with the resonator disc, and movable means of the adjustment mechanism in the perpendicular direction with respect to the resonator disc for adjusting the resonance frequency. The frequency adjuster includes a plurality of dielectric adjustment plates, which are substantially installed concentrically and parallel one after another. The mechanical engagement of the plates with each other and with the adjustment mechanism enabling movement of the adjustment plates both with respect to the resonator disc and to each other, so that the adjustment plates are arranged in layers on top of each other as the adjusting movement is proceeding. This results in improved linearity of frequency control and a longer adjustment distance, which both improve the adjustment accuracy.

4 Claims, 2 Drawing Sheets

DIELECTRIC RESONATOR HAVING ADJUSTMENT PLATES MOVABLE WITH RESPECT TO RESONATOR DISC AND EACH OTHER

This application claims benefit of international application PCT/FI95/00545, filed Oct. 4. 1995.

BACKGROUND OF THE INVENTION

The invention relates to a dielectric resonator comprising a dielectric resonator disc, a frequency controller comprising an adjustment mechanism and a dielectric adjustment plane, which is substantially parallel with the resonator disc, and movable by means of the adjustment mechanism in the perpendicular direction with respect to the resonator disc for adjusting the resonance frequency, and an electrically conductive casing.

Recently, so-called dielectric resonators have become more and more interesting in high frequency and microwave range structures, as they provide the following advantages over conventional resonator structures: smaller circuit sizes, higher degree of integration, improved performance and lower manufacturing costs. Any object which has a simple geometric shape, and the material of which exhibits low dielectric losses and a high relative dielectric constant may function as a dielectric resonator having a high Q value. For reasons related to manufacturing technique, a dielectric resonator is usually of a cylindrical shape, such as a cylindrical disc.

The structure and operation of dielectric resonators are disclosed e.g. in the following articles:

[1] "Ceramic Resonators for Highly Stabile Oscillators", Gundolf Kuchler, Siemens Components XXIV (1989) No. 5, p. 180–183.

[2] "Microwave Dielectric Resonators", S. Jerry Fiedziuszko, Microwave Journal, September 1986, p. 189–189.

[3] "Cylindrical Dielectric Resonators and Their Applications in TEM Line Microwave Circuits", Marian W. Pospieszalski, IEEE Transactions on Microwave Theory and Techniques, VOL. MTT-27, NO. 3, March 1979, p. 233–238.

The resonance frequency of a dielectric resonator is primarily determined by the dimensions of the resonator body. Another factor that has an effect on the resonance frequency is the environment of the resonator. By bringing a metallic or some other conductive surface to the vicinity of the resonator, it is possible to intentionally affect the electric or magnetic field of the resonator, and thus the resonance frequency. In a typical method for adjusting the resonance frequency of the resonator, the distance of a conductive metallic surface from the planar surface of the resonator is adjusted. Alternatively, it is also possible to bring another dielectric body to the vicinity of the resonator body instead of a conductive adjustment body. One prior art filter design of this kind, based on dielectric plate adjustment is shown in FIG. 1, in which a resonator comprises inductive coupling loops 5 (input and output), a dielectric resonator disc 3 installed in a metal casing 4, and supported by a dielectric leg 6, and a frequency controller attached to the metal casing 4, comprising an adjustment screw 1 and a dielectric adjustment plane 2. The resonance frequency of the resonator depends on the adjustment distance L in accordance with a graph shown in FIG. 2.

As appears from FIG. 2, the resonance frequency varies as a non-linear function of the adjusting distance. Due to this non-linearity and the steep slope of adjustment, accurate adjustment of the resonance frequency is difficult and demands great precision, particularly at the extreme ends of the control range. Frequency adjustment is based on a highly accurate mechanical movement, the slope of adjustment k also being steep. In principle, the length and thus the accuracy of the adjusting movement may be increased by reducing the size of the metallic or dielectric adjustment plane. Due to the non-linearity of the above-mentioned adjusting techniques, however, the achieved advantage is small, since the portion of the adjusting curve which is too steep or too flat either at the beginning or at the end of the adjusting movement can not be used. When the resonance frequency becomes higher, e.g. to the range 1500–2000 MHz or higher, the dimensions of the basic elements of the dielectric filter, such as the dimensions of the resonator body or the adjustment mechanism are reduced even more. As a result, adjusting the resonance frequency of a dielectric resonator with prior art solutions sets very high demands on the frequency adjustment mechanism, which, in turn, increases the material and production costs. In addition, as the mechanical movements of the frequency adjustment device must be made very small, adjustment will be slower.

SUMMARY OF THE INVENTION

The object of the invention is a dielectric resonator providing a higher accuracy and linearity of frequency control.

This is achieved with a dielectric resonator, which is characterized in accordance with the invention in that the frequency controller comprises a plurality of dielectric adjustment planes, which are substantially installed concentrically and parallel one after another, the mechanical engagement of the planes to each other and to the adjustment mechanism enabling movement of the adjustment plates both with respect to the resonator disc and each other, so that the adjustment plates are arranged in layers on top of each other as the adjusting movement is proceeding.

In the invention, a conventional single dielectric adjustment plate has been replaced with several thin dielectric adjustment plates, which can move both with respect to each other and with respect to the resonator disc, forming layers on top of the resonator disc as the adjustment is proceeding. The advantages of the invention are improved linearity of frequency adjustment, and a longer adjusting distance, which both improve the accuracy of adjustment.

BRIEF DESCRIPTION OF THE DRAWINGS

In the following, the invention will be disclosed in greater detail by way of example with reference to the attached drawings, in which.

DETAILED DESCRIPTION

The structure, the operation and the ceramic manufacturing materials of dielectric resonators are disclosed e.g. in the above-mentioned articles [1], [2], and [3], which are incorporated herein by reference. In the following description, only the parts in the structure of the dielectric resonator which are essential to the invention will be disclosed.

The term dielectric resonator body, as used herein, generally refers to any object which has a suitable geometric shape, and the manufacturing material of which exhibits low dielectric losses and a high relative dielectric constant. For reasons related to manufacturing technique, a dielectric resonator is usually of a cylindrical shape, such as a cylindrical disc. The most commonly used material is ceramic material.

The electromagnetic fields of a dielectric resonator extend beyond the resonator body, so it may easily be coupled electromagnetically to the rest of the resonator circuit in a variety of ways depending on the application, e.g. by means of a microstrip conductor placed in the vicinity of the resonator, an inductive coupling loop, a bent coaxial cable, a straight wire, etc.

The resonator frequency of a dielectric resonator is primarily determined by the dimensions of the dielectric resonator body. Another factor that has an effect on the resonance frequency is the environment of the resonator. By bringing a metallic or any other conductive surface, or alternatively another dielectric body, i.e. a so-called adjustment body, to the vicinity of the resonator, it is possible to intentionally affect the electric or magnetic field of the resonator, and thus the resonance frequency.

Figure 1:
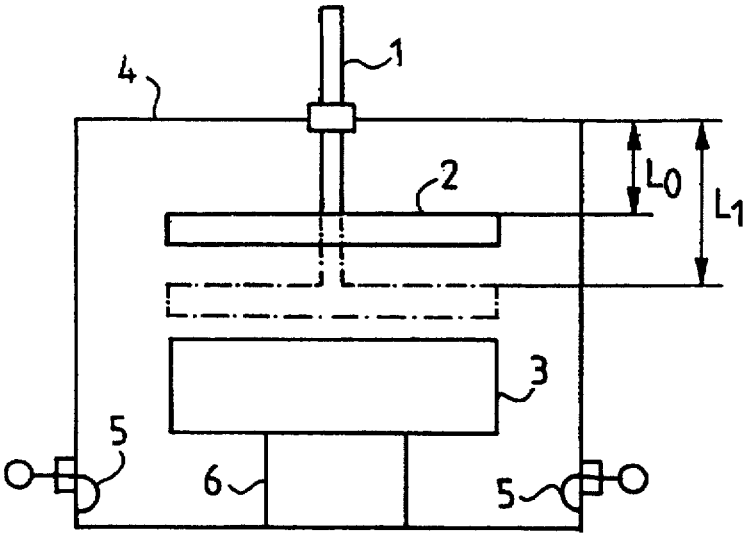
FIG. 1 PRIOR ART
FIG. 1 shows a cross-sectional side view of a dielectric resonator in accordance with the prior art.
Figure 2:
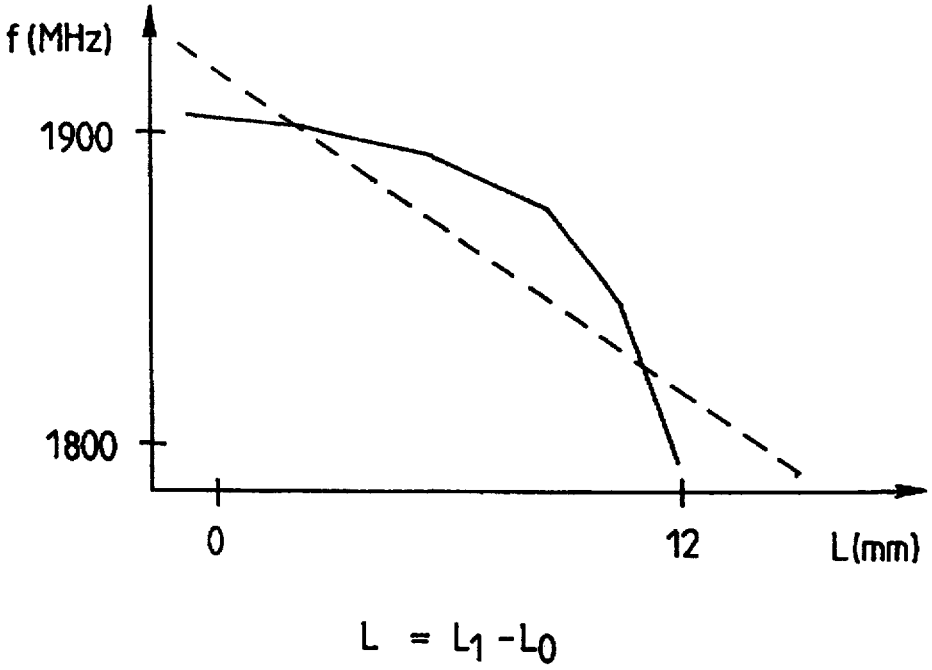
FIG. 2 PRIOR ART
FIG. 2 shows a graph illustrating the resonance frequency of the resonator shown in FIG. 1 as a function of the adjusting distance L.
Figure 3:
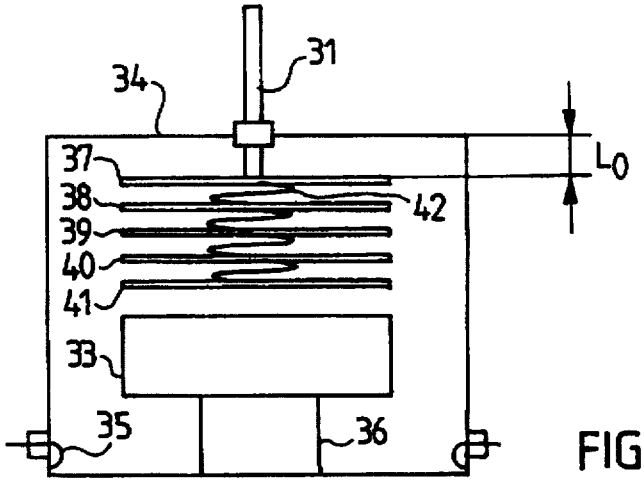
FIGS. 3 and 4 show cross-sectional side views of a dielectric resonator of the invention in two different adjusting positions.
Figure 4:
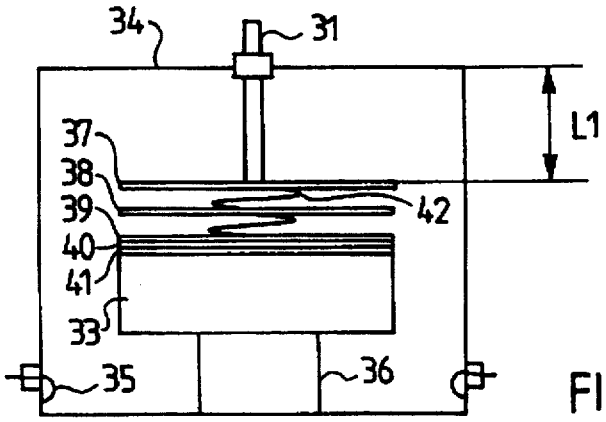

FIGS. 3 and 4 show a dielectric resonator provided with a layer plate adjuster in accordance with the invention. The resonator comprises a dielectric, preferably a cylindrical resonator disc 33 inside a casing 34 made of electrically conductive material, such as metal, said disc being preferably ceramic and placed at a fixed distance from the bottom of the casing 34, to rest on a supporting leg 36 made of suitable dielectric or isolating material. An example of coupling to the resonator by inductive coupling loops 35, which provide the input and the output of the resonator, is shown in FIGS. 3 and 4.

The layer plate adjuster structure comprises a plurality of dielectric adjusting planes 37, 38, 39, 40 and 41, which are installed substantially concentrically and parallel one after another, the mechanical engagement of said planes with each other and to the adjustment mechanism enabling movement of the adjustment plates 37–41 both with respect to the resonator disc 33 and with respect to each other, so that the adjustment plates 37–41 are arranged in layers on top of each other as the adjusting movement is proceeding.

In the embodiment described in greater detail in FIGS. 3 and 4, an adjusting mechanism, such as an adjustment screw 31 has been attached to the top surface of an adjustment plate 37 which is most remote above a resonator disc 33. Each following lower adjustment plate 38–41 is suspended from the bottom surface of a corresponding previous adjustment plate 37–40 by a spring means 42, which in free suspension keeps the adjustment plates 37–41 apart from each other. FIG. 3 shows a situation in which the layer plate adjuster is in its highest extreme position, and the adjustment plates 37–41 are hanging freely apart both from each other and from the top surface of the resonator disc 33.

The adjusting mechanism 31 is arranged to move the adjustment plates 37–41 in the perpendicular direction with respect to the top surface of the resonator disc 33. Thus, in an adjusting movement which is directed downwards, upon the lowest adjustment plate 41 contacting the top surface of the resonator disc 33, the adjustment plates start to move with respect to each other against the force of the spring means 42 between them, as the adjusting movement is proceeding, said adjustment plates forming layers on top of each other on the resonator disc 33, starting from the lowest adjustment plates. FIG. 4 shows a situation in which the lowest adjustment plates 41, 40 and 39 are layered on top of the resonator disc 33 forming a substantially integral object with it. In the other extreme position of the adjusting movement, all the adjustment plates 37–41 are arranged in layers on the resonator disc 33.

In an adjusting movement which is directed upwards, the adjustment mechanism 31 moves the highest adjustment plate 37, whereby the adjustment plates 37–41, layered on top of each other in an upward direction, start to become detached from each other actuated by the spring means 42, starting from the highest adjustment plates, until the situation shown in FIG. 3 is finally reached.

Figure 5:
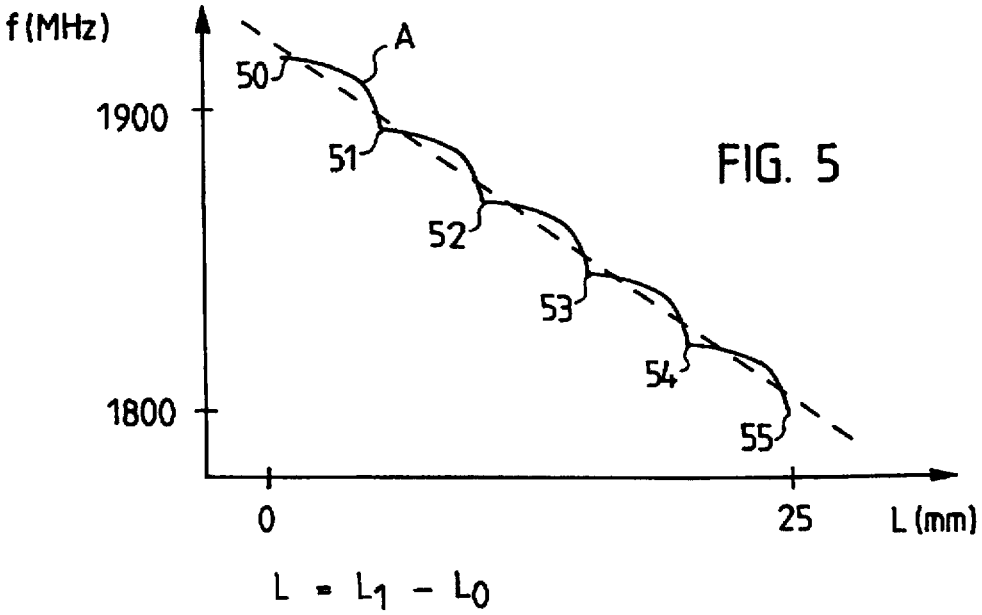
FIG. 5 shows a graph illustrating the resonance frequency of the resonator shown in FIGS. 3 and 4 as a function of the adjusting distance L.

By means of the layer plate structure of the invention, an adjustment curve in accordance with curve A in FIG. 5 is achieved as a function of the adjusting distance L=L1−L0. The highest frequency is achieved when L=0, i.e. in the position in accordance with FIG. 3. The lowest frequency is achieved when all the adjustment plates 37–41 are arranged in layers on the resonator disc. Between points 50 and 51 of the adjustment curve, the lowest adjustment plate 41 approaches the resonator disc 33 until it contacts it at point 51. Thereafter, upon the adjusting movement proceeding downwards, the same happens again alternately to the following adjustment plates at points 52, 53, 54 and 55. Thus, a relatively linear frequency adjustment and a long adjustment distance are achieved. The linearity may be increased by reducing the size or the thickness of the adjustment plates, and the adjusting distance may be lengthened by increasing the number of the adjustment plates.

The figures and the explanation associated therewith are only intended to illustrate the above invention. The resonator of the invention may vary in its details within the scope of the attached claims.

I claim:

1. A dielectric resonator, comprising a dielectric resonator disc, an electrically conductive casing, a plurality of dielectric adjustment plates which are installed concentrically and parallel with each other and said dielectric resonator disc, a mechanical engagement between said dielectric adjustment plates enabling movement of said adjustment plates in relation to each other and said dielectric resonator disc, an adjustment mechanism for moving said dielectric adjustment plates in a direction perpendicular to the dielectric resonator disc, for adjusting the resonance frequency of the dielectric resonator, the adjustment plates being arranged to be gradually stacked on said dielectric resonator disc during an adjusting movement towards said dielectric resonator disc, and said adjustment plates being arranged to be gradually unstacked from said dielectric resonator disc during an adjusting movement away from said dielectric resonator disc.

2. A dielectric resonator, comprising a dielectric resonator disc, an electrically conductive casing, a plurality of dielectric adjustment plates which are installed concentrically and parallel with each other and said resonator disc, an adjustment mechanism connected to the one of said adjustment plates which is the most remote one above the resonator disc, for moving said dielectric adjustment plates in a direction perpendicular to the resonator, for adjusting the resonance frequency of the dielectric resonator, a spring mechanism for suspending each of the following ones of said dielectric adjustment plates from the respective previous one of said dielectric adjustment plates, said spring mechanism being arranged to keep said dielectric adjustment plates apart from each other in a free suspension, and the adjustment mechanism being arranged to act against the spring mechanism for gradually stacking the dielectric adjustment plates on said resonator disc during an adjusting movement towards said resonator disc.

3. A dielectric resonator comprising a dielectric resonator disc, an electrically conductive casing, a plurality of dielectric adjustment plates, which are installed substantially concentrically and parallel one after another and substantially parallel with the resonator disc, an adjustment mechanism for moving said dielectric adjustment plates in a direction perpendicular to the resonator disc, for adjusting the resonance frequency, the mechanical engagement of said plates with each other and with the adjustment mechanism enabling movement of the adjustment plates both with respect to the resonator disc and with respect to each other, so that the adjustment plates are arranged in layers on top of each other as the adjusting movement is proceeding, spring means, said mechanical engagement comprising that the adjustment mechanism is connected to the adjustment plate most remote above the resonator disc, and that each following one of the adjustment plates being suspended from the bottom surface of the respective previous one of said adjustment plates by said spring means, which in free suspension keeps the adjustment plates apart from each other.

4. A resonator as claimed in claim 3, wherein the adjustment mechanism is arranged to move the adjustment plates in the direction perpendicular to the top surface of the resonator disc, so that in an adjusting movement which is directed downwards, upon a lowest one of said adjustment plates contacting the top surface of the resonator disc, the adjustment plates start to move with respect to each other against the force of said spring means, as the adjusting movement is proceeding, said adjustment plates forming layers on top of each other on the resonator disc, starting from the lowest one of said adjustment plates, and wherein in an adjusting movement which is directed upwards, the adjustment plates layered on top of each other start to become detached from each other actuated by said spring means starting from said most remote adjustment plate.

* * * * *